US005191972A

United States Patent [19]

Helzer et al.

[11] Patent Number: 5,191,972

[45] Date of Patent: Mar. 9, 1993

[54] STORAGE AND DISPLAY DEVICE FOR COINS AND THE LIKE

[75] Inventors: James A. Helzer; David P. Hanefeld; Dwight Hayes, all of Cheyenne, Wyo.

[73] Assignee: Unicover Corporation, Cheyenne, Wyo.

[21] Appl. No.: 849,593

[22] Filed: Mar. 11, 1992

[51] Int. Cl.[5] ..... A45C 1/00

[52] U.S. Cl. ..... 206/840; 206/8; 206/83; 206/472; 206/488

[58] Field of Search ..... 206/80, 81, 83, 84, 206/456, 472, 473, 477, 483, 488

[56] References Cited

U.S. PATENT DOCUMENTS

| | | | |
|---|---|---|---|
| 2,258,535 | 10/1941 | Buranelli | 206/84 |
| 3,139,977 | 7/1964 | Burdick | 206/83 |
| 3,624,832 | 11/1971 | Dunn | 206/83 |
| 3,635,335 | 1/1972 | Kramer | 206/83 |
| 3,822,782 | 7/1974 | Ringle et al. | 206/83 |
| 4,002,355 | 1/1977 | Sendor | 206/472 |
| 4,043,477 | 8/1977 | Deese . | |
| 4,063,639 | 12/1977 | Grant . | |
| 4,165,573 | 8/1979 | Richards | 206/80 |
| 4,207,980 | 6/1980 | Namiki | 206/456 |
| 4,385,688 | 5/1983 | Grant . | |
| 4,425,997 | 1/1984 | Grant . | |
| 4,771,886 | 7/1988 | Johnson | 206/472 |
| 5,042,650 | 8/1991 | Mayer et al. . | |

*Primary Examiner*—David T. Fidei
*Attorney, Agent, or Firm*—Larson and Taylor

[57] ABSTRACT

A device for storage and display of small, generally planar articles such as coins or the like, comprises one or more generally planar compartments for displaying a face of one or more articles. The articles are held in a cavity, preferably a closed, dust-tight cavity, of a generally planar article holder having a pair of opposed walls having the cavity therebetween. The article holder is releasably held in a display compartment by a generally planar retainer member which bears against an article holder which is correctly positioned in the display compartment. The article holder is also prevented from lateral movement in the display compartment and is thus held in an article viewing position in the display compartment whereby an article which is correctly positioned in the article holder is properly positioned in a display compartment and is viewable through an aperture in the retainer and through a transparent wall of the holder.

14 Claims, 3 Drawing Sheets

STORAGE AND DISPLAY DEVICE FOR COINS AND THE LIKE

BACKGROUND OF THE INVENTION

This invention relates to a device for storage and display of small, generally planar articles having opposed major faces, such as coins, medals, and the like. The invention has particular applicability to devices for the storage and display of coins. However, while reference will be made hereinafter to the storage and display of coins, it will be understood that the device is also useful for the storage and display of similar articles such as medals and the like.

There are several storage and display devices which are commercially available, and many others have been described. Each of the known devices has shortcomings. Accordingly, there is a need for improved devices of this type.

Commercially available devices of this type for displaying and storing coins and the like are described, for example, in the following U.S. Pat. Nos.:

Deese, U.S. Pat. No. 4,043,477
Grant, U.S. Pat. No. 4,063,639
Grant, U.S. Pat. No. 4,385,688
Grant, U.S. Pat. No. 4,425,997
Mayer, et al., U.S. Pat. No. 5,042,650.

Among the commercial devices described in the foregoing patents is a plastic or cellophane envelope or the like in which a coin is inserted. The envelope is closed by stapling. While this device is inexpensive, the envelope is often mutilated when the coin is removed and, of course, the container is not sealed to any significant degree. Several commercially available systems are described in the Grant patent. Among these is the Whitman holder which is said to be subject to tarnishing. Another system described by Grant requires complete disassembly to add or remove a single coin.

The various devices proposed in the foregoing patents also have shortcomings. Deese, U.S. Pat. No. 4,043,477, relates to a relatively complex and inherently expensive device having interlocking elements which may be connected to form a sheet of devices. Grant, U.S. Pat. No. 4,063,639, relates to a device in which a coin is held between mating threaded transparent cup members which are screwed together to encapsulate the coin. These may be mounted on an apertured board, in which case the mating cup members are mounted from opposite sides of the board. The device thus requires precisely sized mating cup members and a correspondingly precisely sized aperture board, both of which are specifically designed for the purpose. Grant, U.S. Pat. No. 4,385,688, relates to a device which is a flat, generally rectangular container having upper and lower members sealed along three edges and having an open end defined by fourth edges which permit an article to be received and contained within the container, together with a receptacle having compartments for receiving a container with an article contained therewithin. The receptacle has container closing means which cooperate with the fourth edges of the container, urging them together to close the open end of the container when it is located within the receptacle. Thus, the device requires the use of a container having little or no utility apart from the combination and is inherently expensive. Grant, U.S. Pat. No. 4,425,997, is similar to Grant, U.S. Pat. No. 4,385,688, in showing a device in which an article to be stored is first placed between a layer of flexible transparent sheets which are in turn positioned between two plate members. When the plate members are assembled, the edges of the sheets are compressed together and a plurality of the storage devices may be mounted on an apertured display board. Mayer, et al., U.S. Pat. No. 5,042,650, relates to a tamper-proof coin case defined by two interlocking plastic plate members which are ultrasonically bonded together to define a unitary assembly within which a coin and its certificate of authenticity may be permanently secured.

It is an object of the present invention to provide a device for displaying and storing generally planar articles having opposed major faces, such as a coin, medal, or the like, which is readily provided in the form of an album or the like suitable for storing a plurality of such articles. It is a further object to provide such devices which are attractive, yet relatively inexpensive. It is a further object to provide such devices which can accommodate an article which is itself enclosed or sealed in a conventional holder such as a pair of opposed films. It is still a further object to provide such a device in which an article can be removed without disturbing other articles stored and displayed in that device.

SUMMARY OF THE INVENTION

The foregoing and other objects which will be apparent to those of ordinary skill in the art are achieved in accordance with the present invention by providing an article display and storage device for displaying a generally planar article having opposed major faces, said article being enclosed in an article holder having a pair of opposed, generally planar walls defining an article-holding cavity therebetween, at least one of said walls being transparent to permit viewing a major face of an article in said cavity, said device comprising:

(a) a generally planar article-displaying compartment for receiving in an article displaying position in said compartment, an article holder having in said article-holding cavity thereof an article to be displayed;

(b) an apertured, generally planar article holder retaining member for retaining an article holder in said article-displaying position in said article-displaying compartment, said retaining member being releasably retainable in an article holder retaining position in said article-displaying compartment, having an article holder engaging portion for bearing against an article holder in a respective article-displaying compartment to retain an article holder in said compartment, and having an aperture to permit viewing a major face of an article in the article-holding cavity of an article holder in said article-displaying position in said article-displaying compartment;

(c) means for preventing lateral motion of article holder, when an article holder is positioned in said article displaying position, in a plane parallel to that of the article displaying compartment; and (d) means for releasably retaining said article holder retaining member in an article holder retaining position in said article-displaying compartment such that, when an article holder having an article in said cavity is in said article-displaying position in said compartment, the article holder engaging portion of said retaining member bears against the article holder and retains the article holder in position in said article displaying compartment such that a major face of the article is viewable through the aperture in the article holder cover member and through a transparent wall of an article holder.

DESCRIPTION OF PREFERRED EMBODIMENTS

Figure 1:
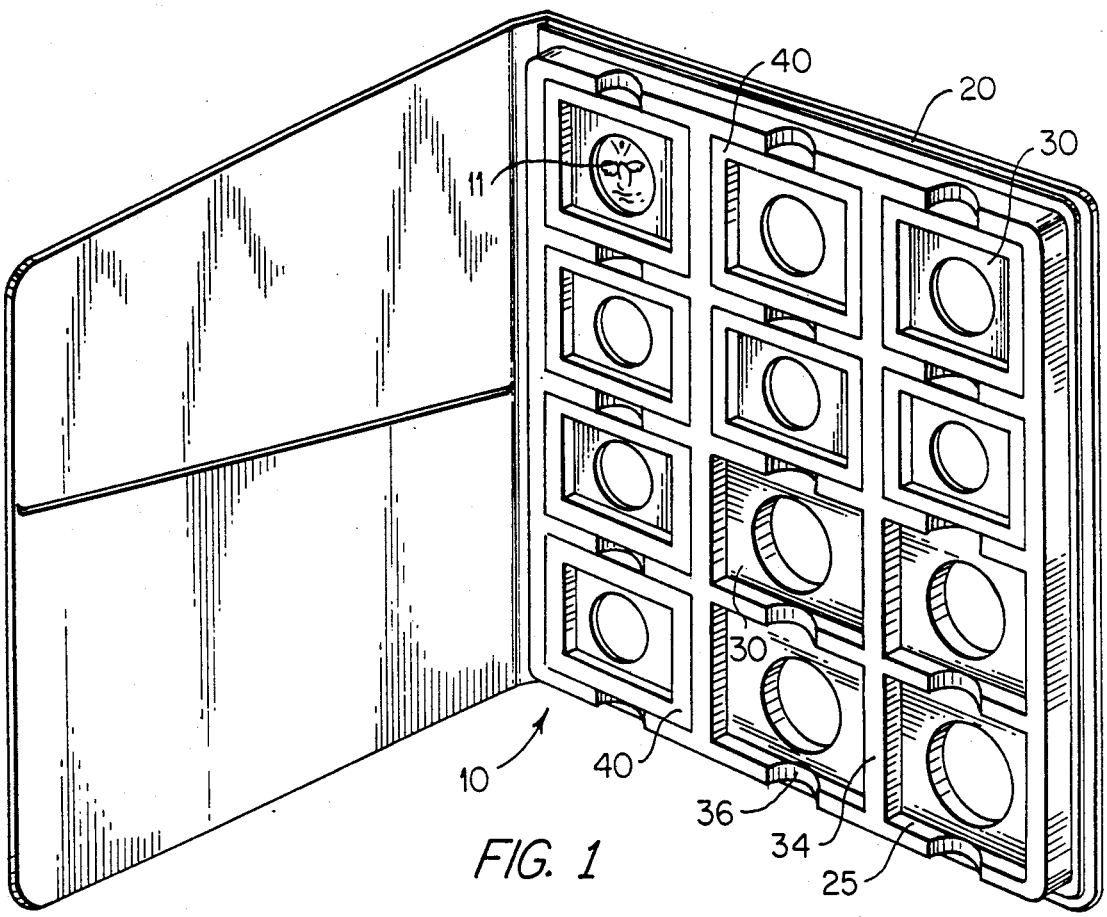
FIG. 1 is a perspective view of a display and storage device in accordance with the invention.
Figure 3:
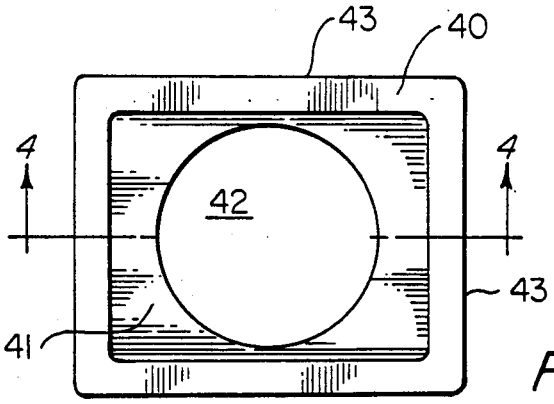
FIG. 3 is a plan view of an article holder retaining member utilized in the device of FIG. 1.
Figure 4:
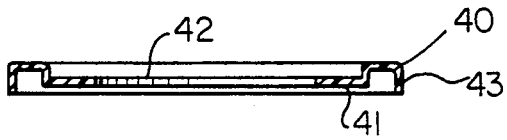
FIG. 4 is a sectional elevation view along the lines 4—4 of FIG. 3.

With reference to FIGS. 1–9, an article display and storage device 10 for displaying a generally planar article 11 having opposed major faces, such as a coin or medal, comprises one or more generally planar article displaying compartments 30, and an apertured generally planar article holder retaining member 40 for each compartment. Each article displaying compartment 30 is provided for displaying an article in an article displaying position in which the article has a major face in a plane parallel to that of the compartment. The device preferably has a plurality of such compartments in side-by-side substantially coplanar arrangement, the device shown in FIG. 1 having twelve such compartments, each in this case for displaying one face of an article. The face of an article 11 is shown in the top left compartment of FIG. 1.

Figure 11:
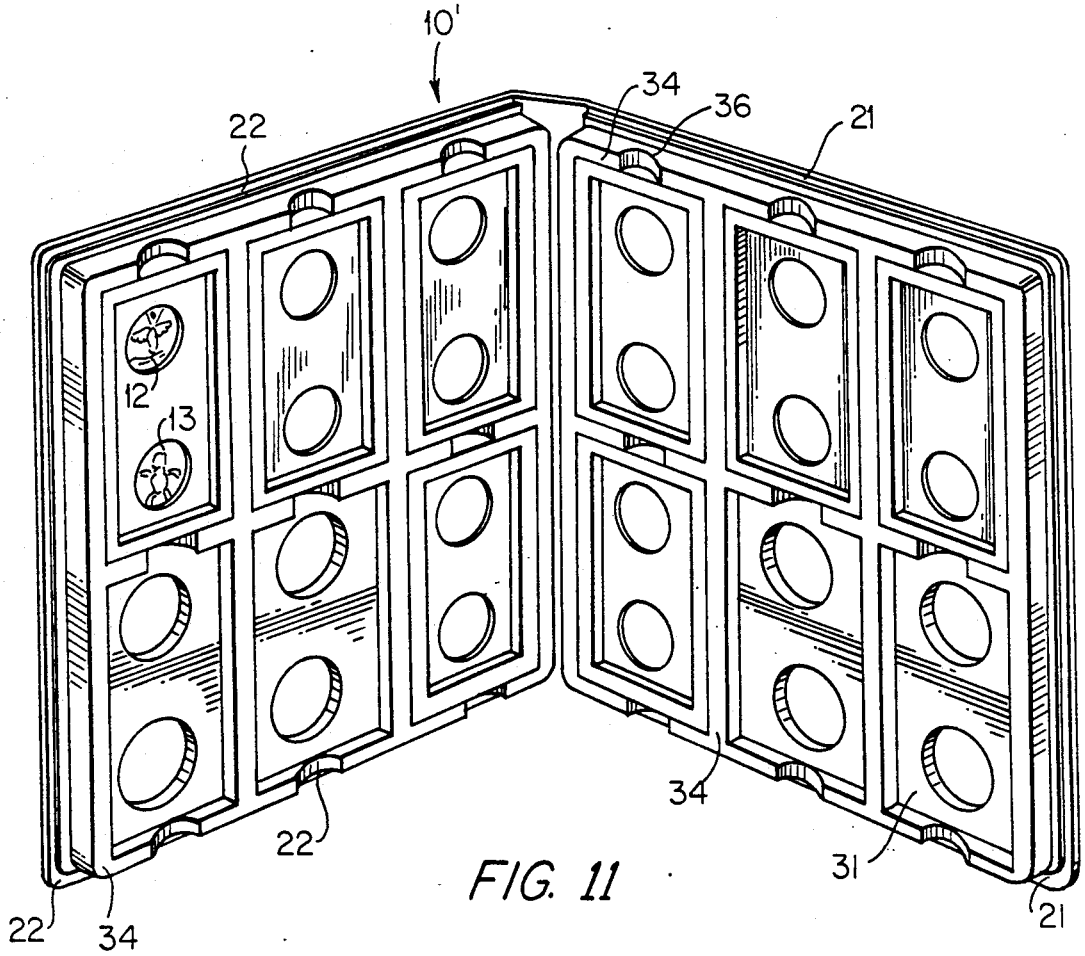
FIG. 11 is a perspective view of a second embodiment of a display and storage device in accordance with the invention.

The compartments are preferably carried by, or are formed in, a generally planar support member such as support member 20 of FIG. 1 or by a plurality of such members such as support members 21 and 22 in the storage and display device 10′ shown in FIG. 11. Preferably the device is in the form of an album such as shown in FIGS. 1 and 11 in which at least one compartment is provided on each leaf or page of the album, with the plane of each compartment being substantially parallel to the plane of the leaf or page. Each compartment 30 may be adapted to display more than one article face. For example, compartments 31 of device 10′ of FIG. 11 are each adapted to display two article faces. In the device of FIG. 11, each leaf or page 21,22 of the album is provided with six article displaying compartments, each compartment 31 being capable of displaying two article faces such as faces 12 and 13 shown in the top left compartment of the left hand page 22.

Article holder retaining member 40 is intended to retain an article holder in an article displaying compartment. The article holder holds an article to be displayed and when the article holder is retained in an article displaying position by the article holder retaining member, the article in that holder is in position to be displayed in an article displaying compartment of that device. Suitable article holders are illustrated in FIGS. 5–10 and generally include a pair of opposed, generally planar walls defining an article holding cavity therebetween, at least one of the walls being transparent.

Retaining member 40 is a generally planar member and is releasably retainable in an article holder retaining position in an article-displaying compartment. In FIG. 1, eight retaining members 40 are shown retained in this position in their respective compartments 30. Retaining member 40 includes an article holder engaging portion 41 for bearing against an article holder to retain an article holder in its compartment and has an aperture 42 to permit viewing a major face of an article when the article is positioned in an article-displaying position in the cavity of an article holder and when the article holder is positioned in the article displaying position in compartment 30.

The storage and display device further comprises means for preventing motion of an article holder laterally out of its article-displaying position in a plane parallel to that of the article-displaying compartment. In the embodiments shown in FIGS. 1 and 11, such means may comprise a depression 32 in the floor 33 of compartment 30, or one or more upstanding ribs 34 circumscribing compartment 30, or both.

The device also includes means for releasably retaining the article holder member in an article holder retaining position in the article-displaying compartment to retain an article holder in an article-displaying position in the compartment. In this manner an article which is itself held in an article-viewing position in the article holder, is held in an article-displaying position in the display compartment and is viewable through the aperture in the article holder retainer and transparent wall of the article holder.

In the device depicted in FIGS. 1 and 11, the article holder retainer 40 is releasably retained in compartment 40 by frictional engagement with the inner upstanding peripheral wall of rib members 34 which circumscribe a respective compartment. Thus, when an article holder is in its article-displaying position in a compartment, and when the retainer member 40 is fitted within the ribs 34 surrounding compartment 30, portion 41 of retainer 40 bears downwardly against the article holder, thus preventing motion of the article holder in a direction out of the plane of compartment 30. Thus, the article holder, and of course the article therein, is held in the article-displaying position in compartment 30.

The article holder has a pair of opposed generally planar walls defining an article-holding cavity therebetween. At least one of the walls is transparent to permit viewing a major face of an article held in the cavity.

Figure 5:
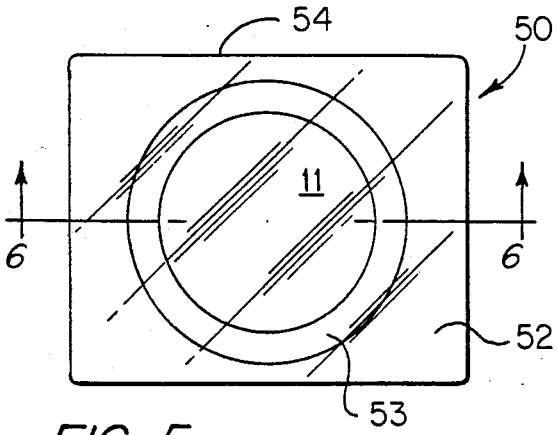
FIG. 5 is a plan view of an article holder utilized in the device of FIG. 1.
Figure 7:
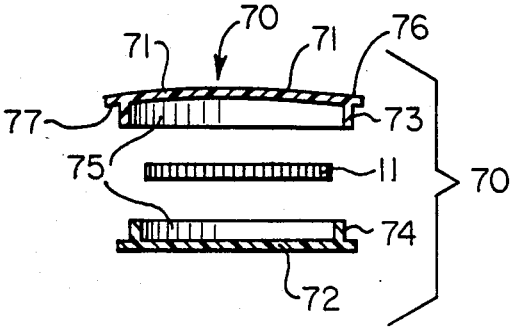
FIG. 7 is an exploded sectional view of a second form of article holder utilizable in the device of FIG. 1.

It is preferred that an article in the cavity of an article holder is held in a predetermined article-viewing position in the holder to ensure that the article in the cavity is in a predetermined article-displaying position in a display compartment when the article holder is correctly positioned in the display compartment. This can be accomplished by providing article positioning means in the article holder or by selecting the size or shape or both of the article holder, or, in the case of an article holder made of flexible film, by providing an article-receiving depression in the floor of a display compartment, or by various combinations of these means. For example, the cavity of a round article holder such as shown in FIGS. 5 or 7 may have a diameter sized to hold a round coin of a slightly smaller diameter, while having a height sufficient to accommodate coins of various height. A shim or spacer could be placed in the cavity under the coin to ensure that a relatively thin coin is tightly held in the cavity when the holder is assembled.

Figure 6:
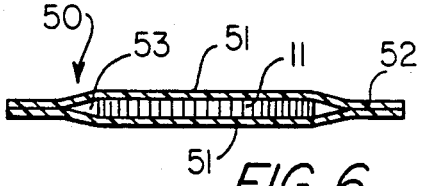
FIG. 6 is a sectional side elevation view along the lines 6—6 of FIG. 5.

A first suitable article holder 50 is shown in FIGS. 5 and 6 and comprises opposed flexible films 51 which may be separate films, in which case they may be made of the same or of differing materials, or a single folded film. The films are preferably peripherally securable, preferably by a continuous peripheral seal 52, to form a cavity, preferably a closed or sealed cavity 53 for holding article 11 between opposed film 51. Preferably both films 51 are transparent.

Figure 8:
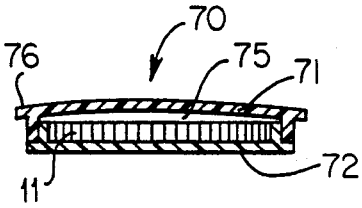
FIG. 8 is a sectional side elevation view of the article holder depicted in FIG. 7, shown in its assembled position.

A second suitable article holder 70 is shown in FIGS. 7 and 8 and comprises opposed, rigid generally planar transparent enclosure members 71,72. Member 71 is transparent and is intended to be outermost when the holder is positioned in compartment 30. Member 72 may also be transparent but need not be. Article holder 70 is circular in plan view. Outermost member 71 has a downwardly extending flange 73 having an inner periphery which corresponds in size to the outer periphery of flange 74 extending from member 72, flange 74 thus fitting within flange 73 when the members are brought together to form a closed cavity 75 for enclosing an article 11 such as a coin, medal, or the like. In both types of article holder it is possible to hermetically seal an article within the article holder cavity. However, a dust-tight and substantially air-tight closure will normally suffice. While circular article holders are illustrated, it will be understood that they need not be. For example, an article holder cavity which is a regular polygon in plan view is suitable for holding a round article, a rectangular cavity is suitable for holding an oval article, and so forth.

In the embodiment illustrated, the outer periphery of flange 73 of article holder 70 is sized to fit closely within recess 32 of compartment 30 to position holder 70 in its correct article-displaying position. Member 71 of holder 70 has a further flange 76 extending peripherally outwardly from outermost member 71 beyond the outer periphery of flange 73 and located at the top, in the sense of FIG. 8, of article holder 70. The lower surface 77 of flange 76 is intended to rest on floor 33 of compartment 30 when holder 70 is fully seated in recess 32.

Figure 9:
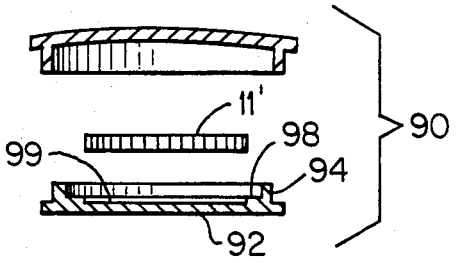
FIG. 9 is an exploded sectional side elevation view of a third embodiment of an article holder utilizable in the device FIG. 1.
Figure 10:
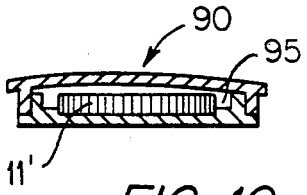
FIG. 10 is a sectional side elevation view of the article holder of FIG. 9, shown in its assembled position.

A third suitable article holder 90 is shown in FIGS. 9 and 10 which is the same as the embodiment of FIGS. 7 and 8 except that floor 91 is adapted to hold articles of different size in correct position. Holder 90 is again circular in plan view. The inner periphery of flange 94 is of appropriate diameter, similarly as flange 74 in holder 70, to hold in correct position a circular article of corresponding diameter, or a square article having a diagonal corresponding to the diameter of cavity 95, and so forth. Floor 98 of member 92 is circular in plan and has a concentric recess 99 sized for holding an article 11' of smaller size such as a circular coin having a diameter corresponding to the diameter of recess 99.

Figure 2:
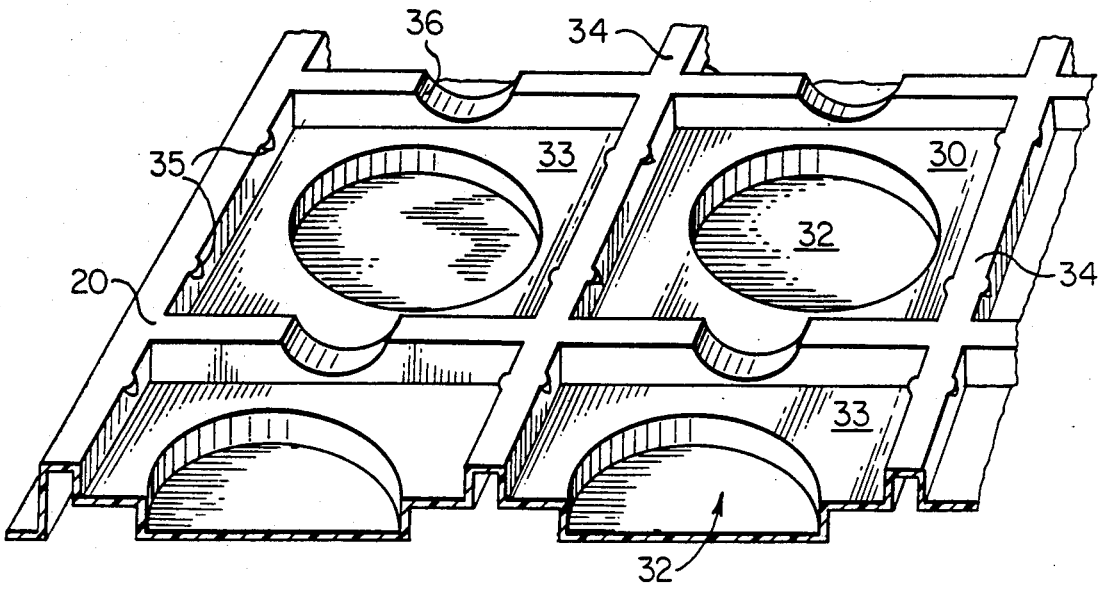
FIG. 2 is a perspective view of a portion of the device of FIG. 1.

In the embodiment of FIG. 1, depression 32 may function to restrain lateral motion of an article holder in which case it has a peripheral size and shape which causes the article holder to be correctly positioned in the desired article-displaying position in compartment 30 and to be restrained from lateral motion out of that position. In the case of a circular article holder, a type commonly used for a circular article such as a round coin, depression 32 may be circular as shown but may be of any other shape, such as a square or other regular polygon, provided only that the recess is sized to prevent lateral motion of the article holder in the compartment.

Where the article holder is of the flexible film package type as shown in FIGS. 5 and 6, it may be prevented from lateral movement in compartment 30 solely by sizing the outer periphery of the film package such that it engages one or more members such as upstanding ribs 34 in compartment 30. For example, the periphery 54 of the films making up holder 50 in FIG. 5 is sized to fit closely within the ribs 34 of a compartment 30 as shown in FIG. 2. Thus, recess 32 can be eliminated. However, it is preferred to retain recess 32 in that it can serve to assist in the correct positioning of an article 11 held in the cavity of a film-type holder 50. It is important to correctly position the article in its article-displaying position in compartment 30 and the article is usually free to move, at least to a limited extent, laterally in the cavity of a film-type of holder such as holder 50. Recess 32 thus serves to restrict such free movement. In any event it will be understood that the periphery of an article holder may be sized to engage one or more members such as rib members 34 to restrain lateral movement of the article holder in compartment 30 to ensure that the article holder is held in a correct article-displaying position in the compartment. Since an article is similarly positioned in its correct article-displaying position in the cavity of the article holder, correct positioning of an article in a display compartment of the display and storage device is enhanced. Normally, in a device having a plurality of side-by-side display compartments in which a single article face is displayed in a compartment, the article and article holder are positioned centrally in a compartment. Circular articles are normally positioned concentrically in circular article holders and in circular recesses in the display compartment.

Article holder retainer member 40 serves to hold the article holder in correct position in a display compartment. It serves to prevent motion of the generally planar article holder out of its plane when it is properly seated and positioned in a display compartment. Aperture 42 in the retainer member is sized to permit viewing of the uppermost surface of an article correctly positioned in the display compartment. However, aperture 42 is also sized such that a portion 41 of the cover member bears against the upper surface of an article holder correctly positioned in display compartment 30, thus retaining the article holder in that position. Portion 41 is not within aperture 42 and thus does not interfere with the viewing of an article in its article-displaying position in compartment 30. Retainer member 40 is releasably retained in compartment 30 in a position to retain an article holder in its article-displaying position in compartment 30. This can be effected in any convenient manner such as by sizing the outer periphery 43 of retainer member 40 to frictionally engage within the inner walls of ribs 34 circumscribing compartment 30. Alternatively or in addition, projections 35 may be provided to positively retain member 40 in its fully seated article holder-retaining position in compartment 30.

The device shown in FIG. 1 is in the form of an album for the display and storage of articles such as circular coins. In the device depicted in FIG. 1, twelve individual compartments are formed in a single thermoformed plastic sheet 25. Sheet 25 preferably has a cloth-like or felt-like surface typical of the type found in coin albums and the like. Article holder retaining members 40 may be similarly fabricated. Thus, the album presents a decorative appearance typical of that of coin albums and the like. Notches 36 may be provided in ribs 34 to facilitate removal of cover members 40 from compartments 30. The album-type device is particularly suitable for displaying "crown" size coins having a diameter of 38.71 mm, and other large coins such as those having a diameter of 34.6 mm. Each "page" of the album bearing compartments 30 is typically about 10 inches in width and about 11 inches in height. As mentioned above, each compartment in the device of FIG. 1 is utilized to display the face of a single article. In the case of a coin, for example, one compartment would be utilized to display "heads" and one compartment would be use to display "tails" of the same coin. In the embodiment of FIG. 11, each compartment is utilized to display the faces of two articles. Thus, in a single compartment, the "heads" and "tails" of a coin could be displayed. Moreover, in the embodiment of FIG. 11, two pages or leaves of the album are utilized to display articles. The album may, of course, include any number of pages or leaves for display purposes. The album pages or leaves are fabricated in any conventional manner such as paperboard, plastic-coated paperboard, and the like. In a preferred embodiment, a plastic sheet 25 is thermoformed to form a plurality of compartments and the sheet is bonded to a planar support member, such as the leaf or page of an album, as depicted in FIGS. 1 and 11. The thermoformed sheet is preferably formed and mounted on the planar support member such that at least a portion of the floor of each compartment is directly in contact with the planar support member.

What is claimed is:

1. An article display and storage device for displaying a generally planar article having opposed major faces, said device comprising:

(a) an article holder having a pair of opposed, rigid generally planar walls, at least one of said walls being transparent to permit viewing a major face of an article in said cavity, and means to secure said wall members together to form a closed article-holding cavity therebetween;

(b) a generally planar article-displaying compartment for receiving in an article displaying position in said compartment, an article holder having in said article-holding cavity thereof an article to be displayed;

(c) an apertured, generally planar article holder retaining member for retaining an article holder in said article-displaying position in said article-displaying compartment, said retaining member being releasably retainable in an article holder retaining position in said article-displaying compartment, having an article holder engaging portion for bearing against an article holder in a respective article-displaying compartment to retain an article holder in said compartment, and having an aperture to permit viewing a major face of an article in the article-holding cavity of an article holder in said article-displaying position in said article-displaying compartment;

(d) means for preventing lateral motion of an article holder, when an article holder is positioned in said article displaying position, in a plane parallel to that of the article displaying compartment; and (e) means for releasably retaining said article holder retaining member in an article holder retaining position in said article-displaying compartment such that, when an article holder having an article is in said article-displaying position in said compartment, the article holder engaging portion of said retaining member bears against the article holder and retains the article holder in position in said article displaying compartment such that a major face of the article is viewable through the aperture in the article holder retaining member and through a transparent wall of the article holder.

2. An article display and storage device for displaying a generally planar article having opposed major faces, said device comprising:

(a) an article holder having a pair of opposed, generally planar walls of flexible film peripherally sealable to form an article-holding cavity between said opposed films, at least one of said walls being transparent to permit viewing a major face of an article in said cavity;

(b) means for positioning articles of different types in an article viewing position in said article holder;

(c) a generally planar article-displaying compartment for receiving in an article displaying position in said compartment, an article holder having in said article-holding cavity thereof an article to be displayed;

(d) an apertured, generally planar article holder retaining member for retaining an article holder in said article-displaying position in said article-displaying compartment, said retaining member being releasably retainable in an article holder retaining position in said article-displaying compartment, having an article holder engaging portion for bearing against an article holder in a respective article-displaying compartment to retain an article holder in said compartment, and having an aperture to permit viewing a major face of an article in the article-holding cavity of an article holder in said article-displaying position in said article-displaying compartment;

(e) means for preventing lateral motion of an article holder, when an article holder is positioned in said article displaying position, in a plane parallel to that of the article displaying compartment; and (f) means for releasably retaining said article holder retaining member in an article holder retaining position in said article-displaying compartment such that, when an article holder having an article is in said article-displaying position in said compartment, the article holder engaging portion of said retaining member bears against the article holder and retains the article holder in position in said article displaying compartment such that a major face of the article is viewable through the aperture in the article holder retaining member and through a transparent wall of the article holder.

3. An article display or storage device according to claim 1 or 2 wherein said compartment comprises a generally planar floor circumscribed by at least one rib member upstanding form said floor.

4. An article display and storage device according to claim 3 wherein said floor has a depression for receiving an article holder, said depression having a peripheral configuration such that, when an article holder is placed in said depression, it is positioned in said article displaying position in said compartment and is prevented from said lateral motion.

5. An article display and storage device according to claim 3 wherein the inner peripheral configuration of said at least one upstanding rib member corresponding to the outer peripheral configuration of an article holder whereby, when an article holder is placed in said article-displaying position in said compartment, the article holder is prevented from said lateral motion.

6. An article display and storage device according to claim 4 wherein the periphery of said depression is circular.

7. An article display and storage device according to claim 3 wherein the inner periphery of said at least one upstanding rib member is rectangular.

8. An article display and storage device according to claim 1 or 2 wherein said article holder retaining member comprises a peripheral flange and wherein said article holder retaining means comprises means for releasably engaging said peripheral flange with a peripheral portion of said compartment.

9. An article display and storage device according to claim 8 wherein said peripheral portion of said compartment comprises at least one rib member upstanding form said compartment floor and wherein said article holder retaining means comprises means for releasably engaging said peripheral flange of said article holder retaining means and said at least one rib member.

10. An article display and storage device according to claim 1 or 2 having a plurality of said compartments in side-by-side co-planar arrangement.

11. An article display and storage device according to claim 1 or 2 wherein the compartments are formed in a single plastics sheet.

12. An article display and storage device according to claim 11 wherein said plastics sheet is carried by a planar support member.

13. An article display and storage device according to claim 12 wherein said support member comprises a leaf of an album.

14. An article display and storage device according to claim 13 wherein said album has a plurality of said leaves.

* * * * *